United States Patent [19]

Kelly

[11] Patent Number: 4,934,929

[45] Date of Patent: Jun. 19, 1990

[54] METHOD AND APPARATUS FOR HIGH TEMPERATURE SURFACE TREATMENT OF MATERIALS

[75] Inventor: James F. Kelly, Melbourne, Fla.

[73] Assignee: CYKL Technology, Inc., West Melbourne, Fla.

[21] Appl. No.: 302,939

[22] Filed: Jan. 30, 1989

[51] Int. Cl.[5] ..... F27B 9/28

[52] U.S. Cl. ..... 432/59; 432/225; 432/226

[58] Field of Search ..... 432/8.59, 225, 226, 432/10, 242

[56] References Cited

U.S. PATENT DOCUMENTS

| | | | |
|---|---|---|---|
| 1,551,197 | 8/1925 | Krebs . | |
| 1,895,284 | 1/1933 | Hay . | |
| 2,658,743 | 11/1953 | Speil et al. . | |
| 2,948,521 | 8/1960 | Heiligenstaedt . | |
| 3,202,406 | 8/1965 | Tack . | |
| 3,459,410 | 8/1969 | Uban | 432/225 |
| 3,610,593 | 10/1971 | Varga . | |
| 4,049,134 | 9/1977 | Dolgen . | |
| 4,055,259 | 10/1977 | Sibrava . | |
| 4,128,065 | 12/1978 | Kelly et al. . | |
| 4,217,090 | 8/1980 | White et al. | 432/8 |
| 4,296,072 | 10/1981 | Takacs et al. . | |
| 4,352,969 | 10/1982 | Wulf . | |
| 4,459,104 | 7/1984 | Wollmann . | |
| 4,526,534 | 7/1985 | Wollmann . | |

*Primary Examiner*—Henry C. Yuen

*Attorney, Agent, or Firm*—Jones, Tullar & Cooper

[57] ABSTRACT

A method and an apparatus for treating materials in a combustor are disclosed. A pair of axially aligned slide gates extend longitudinally through the combustion chamber of the combustor. The innermost ends of the gates abut when the gates are closed, with the gates being openable by moving them axially apart to define a treatment aperture. Movement of the two gates permits the aperture to be positioned at a desired location in the combustion chamber, while movement of one gate with respect to the other adjust the width of the aperture.

15 Claims, 4 Drawing Sheets

METHOD AND APPARATUS FOR HIGH TEMPERATURE SURFACE TREATMENT OF MATERIALS

BACKGROUND OF THE INVENTION

The present invention relates, in general, to the treatment of materials in a controlled atmosphere, and more particularly, to surface treatment of materials in oxidizing or reducing atmospheres in the standing waves produced in the combustion zone of a helical flow furnace.

It is well known that various surface treatments can be utilized to enhance the characteristics of materials. For example, plastics can be treated by mechanical abrasion, solvents, acid etching, flame, corona, and hot or cold plasmas, to name a few. Such treatments may be utilized to clean or to activate the surface to receive a coating, to enhance bonding, and for a variety of other reasons as is well known. In the treatment of plastic materials through the use of plasmas, for example, extremely reactive process gases are brought into contact with an article in a reaction chamber, where the gases are ionized to create a plasma which reacts with the surface molecules to change the surface characteristics of the material. The selection of the process gas determines the nature of the surface modification, and the treatment of materials such as polymers can be carried out through the use of a wide variety of gases or gas mixtures, such as nitrogen, argon, oxygen, nitrous oxide, helium, water, ammonia, etc., with each producing a different surface modification in a reproducible and controllable way.

SUMMARY OF THE INVENTION

The present invention is directed to the treatment of materials in a high temperature, controllable environment, and more particularly to the treatment of materials in the standing waves which are formed in the combustion chamber of a high temperature, helical flow furnace such as the incinerator/combustor unit described in U.S. Pat. No. 4,128,065, issued Dec. 5, 1978 to James F. Kelly et al, the disclosure of which is incorporated herein by reference. In accordance with that patent, the combustor/incinerator unit, or furnace, includes a generally cylindrical combustion chamber. Air under pressure is introduced tangentially into the combustion chamber by way of a main air manifold which traverses the entire length of the device. Air holes in the manifold are spaced so that the burning of combustibles begins with a very rich fuel mixture. As the combustion products move in a helical path along the length of the device, air is added until there is an excess of air. The overall air to fuel ratio in the device is three to five times the stoichiometric value. Fuel is introduced into the end of the combustion chamber in a generally axially direction, and is carried in a helical path by the air flow toward the opposite, or outlet end of the combustion zone.

Two fluidic reactions take place in the combustion chamber of the furnace disclosed in the '065 patent. First, the air manifold itself lies in the path of the tangential air flow, and thus causes turbulence in the air stream. This turbulence increases as the combustible fuel/air combination moves toward the outlet end of the combustion zone. Standing waves are created in this air stream Secondly, the swirl combustion created by this air flow is accelerated through the length of the combustion zone so that the combustible materials reach the area of highest turbulence near completion of the combustion process. A three-dimensional shear effect is created in the combustion chamber which enhances turbulence and results in total combustion of the fuel.

An afterburner is provided at the outlet end of the combustion zone which reverses the direction of the burned gases, causing them to flow around the exterior surface of the combustion chamber in a direction contrary to the flow of combustible material within the chamber. Preheated air is added to the exhaust stream in the afterburner so that as the exhaust gas and air mixture flows around the hot walls of the inner combustion chamber, any byproducts that remain in the exhaust are burned. The exhaust gases cool and expand in an enlarged exhaust chamber connected at the end of the afterburner section, where they again change direction to flow in the direction as, and parallel to, the original flow within the combustion chamber but around the outside of the afterburner.

There are three identifiable air/fuel mixture regions within the combustion chamber of the helical flow furnace described in U.S. Pat. No. 4,128,065. At the fuel inlet region of the combustion zone, the mixture is fuel rich. At some point along the length of the chamber, the exact point depending upon the amount of fuel supplied with respect to the amount of air supplied, a stoichiometric mixture exists, where the air/fuel mixture produces complete burning of the fuel without excess oxygen, while further downstream from this region is an oxygen rich mixture. The present invention takes advantage of the existence of these three distinct regions within the combustion chamber to provide surface treatment of materials introduced into the combustion zone at selected locations. Thus, the present invention is directed to a method and apparatus for delivering material to be treated to the combustion chamber of a helical flow furnace, controlling the exact location within the combustion zone of exposure of the material to the combustion products, controlling the time of exposure of material to these products to thereby provide, and to carefully regulate, the surface treatment of the introduced materials. The present invention further includes apparatus for supplying process gases to the combustion products within the combustion zone so as to further treat the surface of the delivered material to thereby modify in a controlled and reproducible manner the surface characteristics of that material.

The furnace of U.S. Pat. No. 4,128,065 is ideal for the surface treatment of materials, because it can be built as a totally enclosed device so that a carefully controlled flame atmosphere can be applied to the material to be treated without contamination of the surrounding environment. The enclosed combustion chamber and the complete incineration of gaseous materials introduced into the combustion chamber avoids the problems of toxic or noxious fume production which creates problems with prior surface treatment devices. The invention also includes apparatus for supplying process gases to the combustion chamber so that the gases will impinge on the article being treated, and further includes a slide-gate mechanism extending through the combustion chamber and located in the helical path of the combustion products for supplying articles to be treated to the desired location within the combustion chamber.

The slide-gate mechanism of the present invention includes a controllable aperture which can be located at any desired position along the length of the combustion chamber so that it will lie in one of the reduction, stoichiometric or oxidation combustion chamber regions. The aperture also can be opened to any selected width to provide control of the length of time that the article to be treated remains in contact with the combustion products and process gas. The slide-gate aperture lies in the "shadow" of the air manifold, and thus is in the path of the helical turbulent flow of gases through the combustion chamber so that the material to be treated interacts with the standing wave in that chamber. In a preferred form of the invention, the slide-gate mechanism consists of a product feed tube having a tubular passageway passing longitudinally through the combustion chamber parallel to the axis thereof and spaced radially from that axis by a distance approximately equal to the radial distance of the air manifold from the axis. The tubular passageway may consist of two elongated cylindrical feed tubes which are axially aligned with each other and which extend into the combustion chamber from opposite ends. Preferably, the feed tubes slide through elongated access guides with their innermost ends meeting and abutting within the combustion chamber. The feed tubes are both longitudinally slidable to locate the point of abutment at any desired position along the length of the combustion chamber. To open the slide-gate mechanism, the abutting ends are separated by sliding either or both of the feed tubes longitudinally away from the other, thereby separating the terminal ends of the tubes to provide a treatment aperture therebetween.

Material to be treated is fed through the feed tubes and is exposed to the atmosphere within the combustion chamber at the aperture between the innermost ends of the tubes. The material to be treated may be a fiber, wire, cable, film, or similar elongated product which may be fed through the feed tube in either direction. In the case of a fiber or wire, the material may be supplied from a supply reel and drawn through the product feed tubes by a suitable take up reel or the like, the fiber or wire being drawn through the feed tubes, and through the aperture between the innermost ends of the tubes, at a rate sufficient to provide the desired product surface treatment, without damaging the material. Thus, the speed at which the product is drawn through the feed tube is coordinated with the width of the aperture in the slide gate mechanism, the temperature of the ambient gases in the combustion chamber, the concentration of the process gas, and like parameters so as to produce the desired modification of the surface characteristics of the product material. It will be understood that if desired, discrete articles can be treated by mounting them on a suitable conveyor and drawing them through the product feed tube for exposure to the process atmosphere within the combustion chamber. The conveyor may be an endless belt or chain type conveyor, for example, with suitable mounting brackets for carrying the articles through the slide gate mechanism.

The processing conditions within the combustion chamber can be controlled in a variety of ways. Thus, a process gas can be introduced into the chamber at any desired location so as to impinge on the article to be treated in a reducing or oxidizing atmosphere, for example. If desired, multiple gases can be introduced at different locations to produce a sequence of different treatments as the material passes through the slide gate mechanism.

The combustor/incinerator described in U.S. Pat. No. 4,128,065, is available as the "Inertron" combustor from Heat Systems-Ultrasonics, Incorporated, 1938 New Highway, Farmingdale, N.Y. and is ideal for surface treatment of materials under controlled conditions because the combustor, or furnace, can be built in a totally enclosed version so that a controlled flame atmosphere can be applied to the product or material to be treated. Process gases other than air or oxygen can be introduced in a controlled way to treat the surface of the product or material as it passes through the slide gate. The combustor is adjustable so that the standing waves in the combustion products can be regulated to produce the desired pressure variations and other effects on the product material. In addition, the combustor can be operated over a wide range of temperatures under operator control, and such temperature variations give the operator a wide choice of reaction conditions at the surface to be treated.

BRIEF DESCRIPTION OF THE DRAWINGS

The foregoing and additional objects, features and advantages of the present invention will be apparent to those of skill in the art from the following detailed description of a preferred embodiment thereof, taken in conjunction with the accompanying drawings, in which:

FIG. 8 is a side elevational view of the unit of FIG. 2;

DESCRIPTION OF PREFERRED EMBODIMENT

Figure 1:
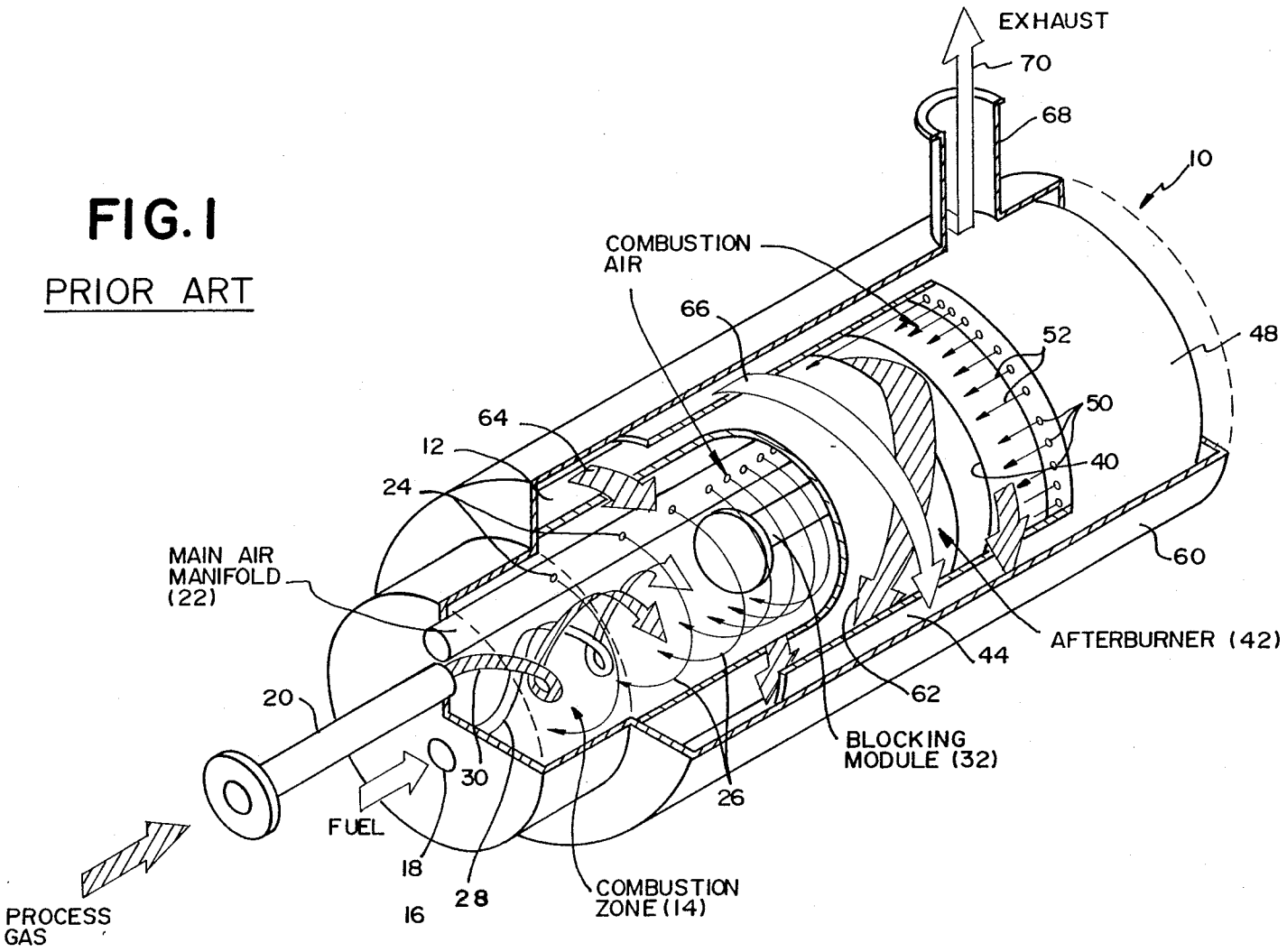
FIG. 1 PRIOR ART
FIG. 1 is a diagrammatic, cutaway, perspective view of the incinerator/combustor unit of U.S. Pat. No. 4,128,065.

FIG. 1 is a diagrammatic, cutaway and perspective view of a combustor/incinerator unit 10 of the type illustrated in U.S. Pat. No. 4,128,065 and Which is utilized, in accordance with the present invention, for the surface treatment of various products and materials, as will be described. Generally, the combustor 10 consists of a generally cylindrical combustion chamber !2 which defines an interior combustion zone 14. The combustion chamber has an inlet end 16 through which fuel is introduced by way of inlet 18 and through which a material to be incinerated, such as a process gas is introduced by way of inlet 20. A main air manifold 22 extends longitudinally through the combustion zone near the wall of the combustion chamber 12. The air manifold 22 includes a plurality of spaced air outlets 24 which introduce air under pressure into the combustion zone in a tangential direction to produce a circumferential air flow as indicated by the arrows 26 in FIG. 1. The swirling effect produced by the main air manifold 22 causes the fuel and the process gas to follow generally helical paths through the combustion zone, as indicated by the arrows 28 and 30, respectively. A blocking module, or baffle 82 extends axially into the combustion chamber from the outlet end 84 (FIG. 2) of the combustion zone to force the process gas, fuel, and air mixture outwardly into the air stream near the surface of the combustion chamber to promote thorough mixture and encourage complete combustion. The blocking module is optional, and may be omitted if the furnace is operated under conditions in which the flame zone extends into the afterburner. The fuel and air mixture, the process gas, and the combustion products flow helically through the combustion chamber with the mixture being very fuel rich at the inlet end, gradually approaching stoichiometry as it passes along the combustion zone with more air being added, and becoming oxygen rich at the outlet end, where 2 to 3.5 times the required amount of air for stoichiometry is present.

The fuel and air mixture is ignited at the inlet end of the combustion zone in anY desired manner, and combustion continues throughout the length of the combustion chamber as the air and fuel mixture swirls helically along the chamber walls. The main air manifold produces a turbulence in the air/fuel flow, with the turbulence increasing as the combustible material moves toward the outlet end of the combustion chamber. Standing waves have been observed in this flow pattern. The maximum amount of turbulence occurs in the region where the combustion process is nearing completion, thereby enhancing the combustion process.

At the outlet end of the combustion chamber, the combustion products pass radially outwardly through an annular exit aperture 40 into an afterburner section 42 which consists of an annular chamber surrounding the outer wall of the combustion chamber 12 The afterburner is formed by a generally cylindrical wall 44 which extends from the end 34 of the combustion chamber longitudinally toward the inlet end !6 of the combustion chamber. Secondary combustion air is supplied to the afterburner by way of an inlet 46 (FIG. 2) leading to a secondary air manifold 48. A plurality of air passageways 50 are provided on the wall of the air manifold to direct air into the afterburner, as indicated by arrows 52 (FIG. 1). The afterburner section 42 may incorporate a perforated intermediate cylinder, as illustrated in U.S. Pat. No. 4,128,065, which serves to dampen low frequency acoustical oscillations between the combustion zone in the combustion chamber and the cool-down sections, which include the afterburner 42 and the following exhaust passage to be described.

The combustion products which enter the afterburner are mixed with the secondary air and flow back toward the inlet end of the unit, flowing around the outer surface of the hot wall 12 of the combustion chamber, where the combustion of the fuel is completed. The combustion products exit the afterburner at its outlet end 54, where the exhaust gases cool and expand in an enlarged exhaust chamber 56. The exhaust gases reverse direction to flow along an outlet exhaust passage 58 which surrounds the afterburner, with the exhaust chamber and exhaust passageway 56 and 58 being defined by a cylindrical exhaust housing 60 which surrounds the combustion chamber and afterburner. The flow of the combustion products from the combustion chamber to the afterburner is illustrated by the arrow 62 in FIG. 1, while the flow of exhaust gases in the exhaust chamber 56 is illustrated by arrow 64. The cooled and expanded exhaust gases flow through the exhaust passageway 58 in the manner illustrated by arrow 66 in FIG. 1, and exit the exhaust stack 68 as indicated by arrow 70.

The composition of the combustion gases within the combustion zone 14 of the unit 10 can be closely controlled by regulating the type of fuel utilized, the flow rate of the fuel, the flow rate of air from the main manifold, and the nature and amount of process gas supplied to the combustion zone. The existence of turbulent flow and the resulting standing waves that are produced in the device under steady state conditions provide identifiable regions within the combustion zone which will have controllable compositions, pressures and temperatures. These zones can be used, in accordance with the present invention, to surface treat various products, a by modifying the chemical composition of the surface molecules of a product positioned at a selected location within the combustion chamber. That location may be selected to apply to the product to be treated a selected gas composition at a desired temperature and pressure to thereby produce the desired results on the surface of the product.

Figure 2:
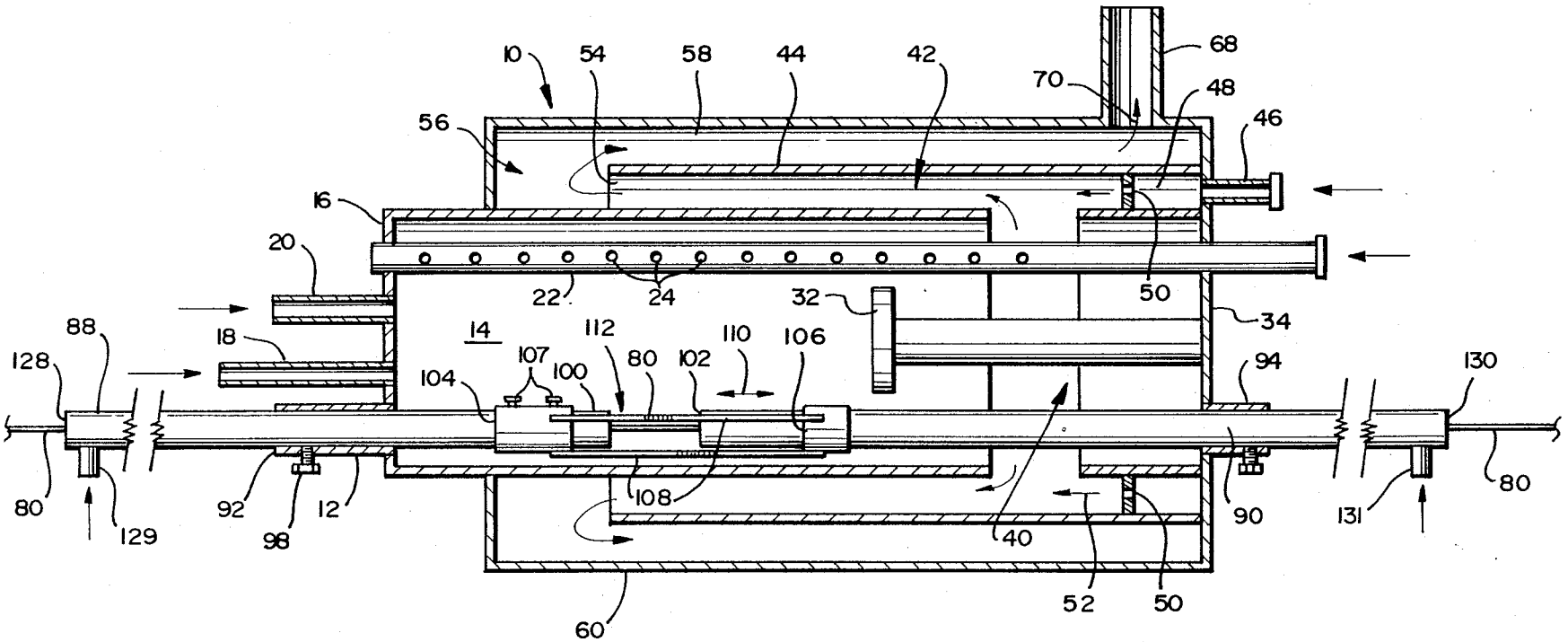
FIG. 2 is a cross-sectional view of the unit of FIG. 1, modified to incorporate the product feed slide-gate of the present invention.
Figure 3:
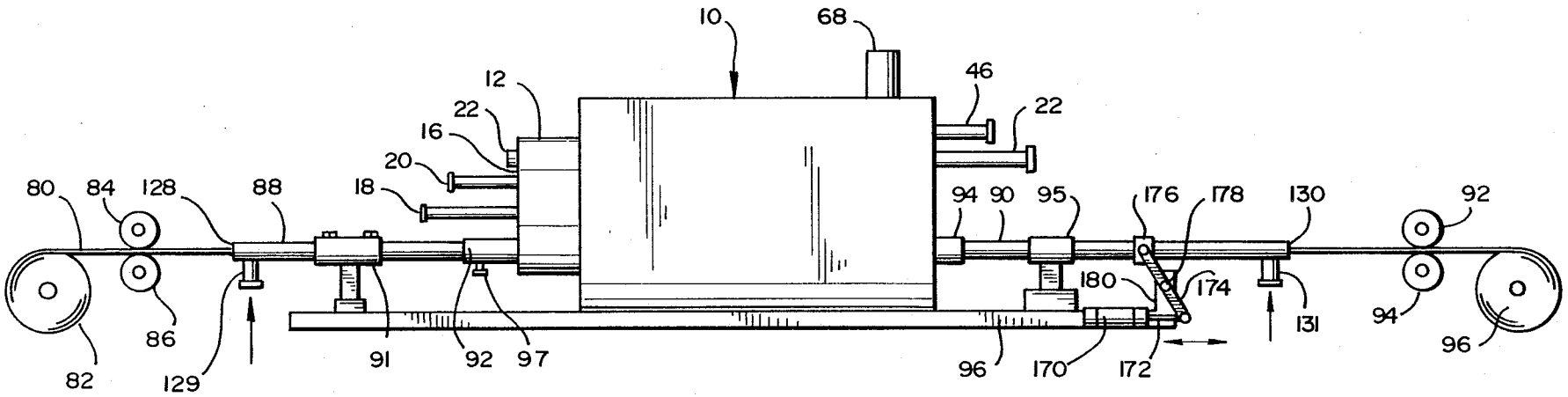

FIG. 2 illustrates a preferred apparatus for positioning products to be treated at a desired location within the combustion zone of the combustor 10. In the example of FIG. 2, the product to be treated is a wire, fiber, cable, or the like, indicated by the strand 80. This strand is supplied, for example, from a reel 82 (see FIG. 8) through a pair of pinch rollers 84 and 86 and through a pair of slide gates 88 and 90 extending longitudinally into the combustion zone. The strand 80 is drawn out the exit end of slide gate 90 and through a pair of guide rollers 92 and 94 by a take up reel 96, for example, if desired, the direction of feed can be reversed, in which case reel 96 becomes a supply reel and reel 82 becomes a take up reel.

The inlet and outlet slide gates 88 and 90, respectively, are slidably mounted in the ends 16 and 84 of the combustor and extend longitudinally through the combustor near the inner surface of the wall thereof, as illustrated in FIG. 2. The slide gates may be mounted in a variety of ways, but for purposes of illustration are shown as secured in the end walls 16 and 34 by means of generally tubular guides 91, 92 and 94, 95, respectively, the guides 92 and 94 being mounted in corresponding apertures formed in the end walls 16 and 34 of the combustor 10. The guides 91 and 92 are spaced away from the combustor 10, and are supported on a common frame 96.

The inlet slide gate 88 is slidably mounted in guides 91 and 92 with the slide gate being tightly fitted in the guide 92 so as to prevent the escape of combustion products from within the furnace. If desired, suitable 0-rings or other seals may be provided to prevent either the escape of combustion gases or the inflow of excess ambient air. A thumb screw 98 or other suitable fastener is provided to secure the slide gate in a selected position so that it will remain stationary during the feeding of products such as the strand 80 into and through the combustion chamber. The slide gate is an elongated feed tube which extends into the combustion chamber and along the length thereof parallel to the chamber axis to a desired location so as to position the inner end 100 of tube 88 in the region of the combustion products where the treatment of the strand is to take place. The slide gate is then secured by the thumb screw 98.

In similar manner, the outlet slide gate 90 is mounted with a close fit into the guide tube 94, which may include suitable seals to prevent flow of combustion products or excess air out of or into the combustion chamber through the guide tube. The outlet slide gate 90 extends longitudinally into the combustion chamber parallel to the chamber axis, and is in axial alignment with the inlet slide gate 88. When the slide gate 90 is fully inserted into the combustion chamber, its inner end 102 will abut the inner end 100 of slide gate 88 to provide a continuous closed tubular passageway for the strand 80 to allow the strand to pass completely through the combustion chamber without being affected by the combustion products.

Figure 4:
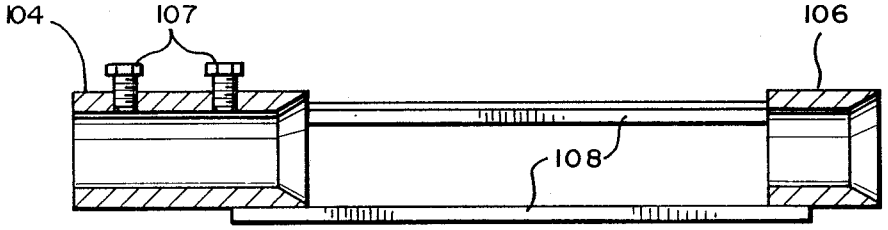
FIG. 4 is an enlarged cross-sectional view of the slide-gate alignment bracket used in the device of FIG. 2.

The inlet and outlet slide gates are held in axial alignment by any suitable mechanism, and thus may be mounted in suitable bushings, or slide collars, which may be secured to the wall of the combustion chamber and which surround the inner ends of the slide gates and support them in spaced relationship with the chamber wall and in alignment with each other. Alternatively, and in the preferred form of the invention illustrated in FIGS. 2 and 4 a fixed collar 104 is secured to the inner end of slide gate 88 and supports a remote, or floating, slide collar 106 surrounding and slidably receiving the inner end of slide gate 90. Three support arms 108 are secured to the fixed collar 104 at one end and to the collar 106 at the other end and serve as a support for the floating collar 106. Collar 104 is fixed on the end of slide gate 88 as by fasteners 107, and by means of collar 106 holds the inner end of slide gate 90 in axial alignment with slide gate 88.

The outlet slide gate 90 is longitudinally movable, as indicated by arrow 110, while remaining coaxial with slide gate 88. Thus, slide gate 90 moves axially through the slide collar 106 and the guides 94 and 95 either inwardly, to bring corresponding ends 100 and 102 into abutment to provide a closed passageway through the combustion chamber, or outwardly, to separate the ends !00 and 102 and to provide a treatment aperture 112 therebetween. This aperture 112 is controllable as to its width (i.e., the distance between ends 100 and 102) by the motion of slide gate 90, and when open exposes the strand 80 to the atmosphere of the combustion chamber. By shifting the slide gate 88 longitudinally in the chamber, the location of its inner end 100, and thus of the aperture 112 can be selected, while motion of the outlet slide gate 90 permits adjustment of the width of the aperture. Accordingly, the nature of the combustion products to which the strand is exposed and the duration of time during which that exposure takes place can be carefully controlled by movement of the two slide gates. It will be apparent that the roles of the two slide gates can be reversed, if desired, making gate 90 the fixed gate, and making gate 88 the movable gate.

Preferably, the slide gates, and thus the opening 112, are located in the "shadow" of the air manifold 22; that is, are located at substantially the same radial distance inwardly from the inner surface of the combustion chamber 12. In this way, the strand within aperture 112 lies in the helical path of the primary air supplied to the combustion chamber and in addition lies in the helical path of the combustion products, including the fuel and any process gas added to the chamber. The strand also lies in the path of turbulent flow created by the location of the air manifold so that the air/fuel/process gas mixture is intimately mixed when it contacts the strand 80.

Although the process gas is shown as being supplied by way of inlet !8 at the end wall 16 of the combustion chamber, it will be apparent that the gas may be supplied at various locations within the combustion chamber simply by relocating the process gas feed line 18 or by extending it into the combustion chamber so that the gas is supplied to the combustion products at the desired location. Another alternative is to supply the process gas through the tubular slide gate passageway so that it flows along the strand 80 and is in contact with the strand when it is exposed to the atmosphere within the combustion chamber 14. The process gas can be supplied through either the strand entrance slide gate passageway or through its exit passageway. In the first case, the gas will be in contact with the strand as it reaches the aperture for contact with the combustion zone, while in the latter case the gas will contact the strand after the strand surface has been contacted by the combustion products. Each case can yield a different treatment result; accordingly, the selection of an exact location for introduction of a process gas has a significant effect on the treatment of the strand.

Figure 6:
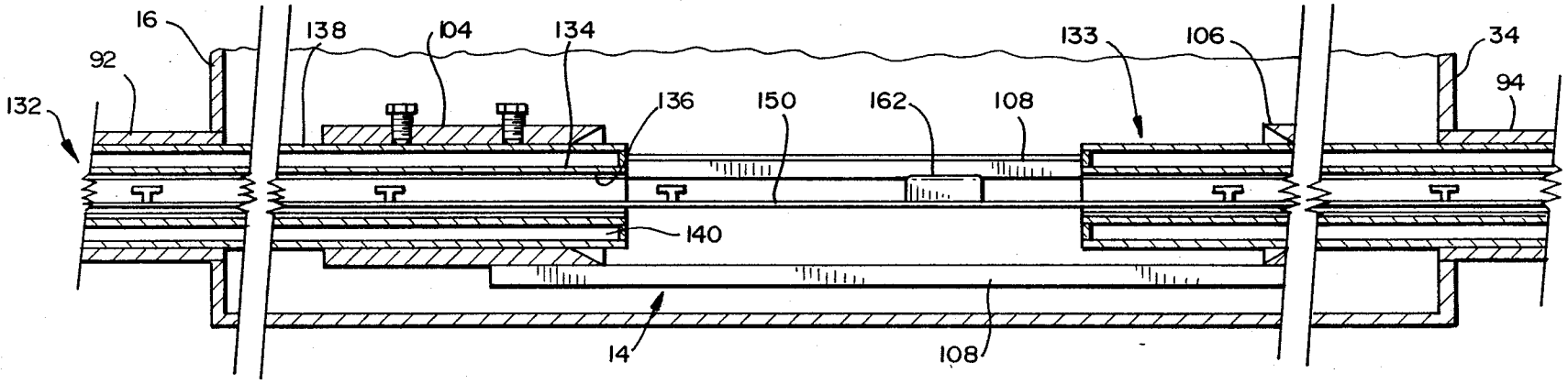
FIG. 6 is a partial cross-sectional view of a modified form of the device of FIG. 2.

As illustrated in FIG. 6, which is an end view of the inner end of slide gate 88, each of the two slide gates 88 and 90 is formed from stainless steel tubing such as the tubing 120, and is lined by a ceramic liner 122. This liner protects the strand 80 as it travels through the slide gate within the combustion chamber, so that the strand will not be overheated. The ceramic liner may in turn be lined by a Teflon coating 124 to facilitate motion of the strand through the central passageway 126 of the slide gate 88. The inner end 100 of the slide gate is open, as illustrated in FIG. 8, while the inlet end 128 (FIG. 2) is closed except for a small aperture just large enough to admit strand 80, to prevent the escape of any significant quantity of combustion products from within the combustion chamber. The inlet end of the slide gate may also include an inlet 129 for process gases, or if desired, cooling air may be introduced into the slide gate passageway to provide additional protection for the fiber. The slide gate 90 is similarly constructed, and may also incorporate at its outlet end 130 a suitable inlet 131 for supplying process gases or cooling air to the interior of the slide gate. The inner end 102 of slide gate 90 is open to the combustion chamber, while the outlet end 130 preferably is closed except for a small aperture to accommodate the strand 80.

Figure 5:
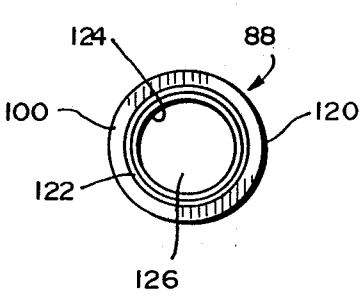
FIG. 5 is an end view of a feed tube used in the device of FIG. 2.
Figure 7:
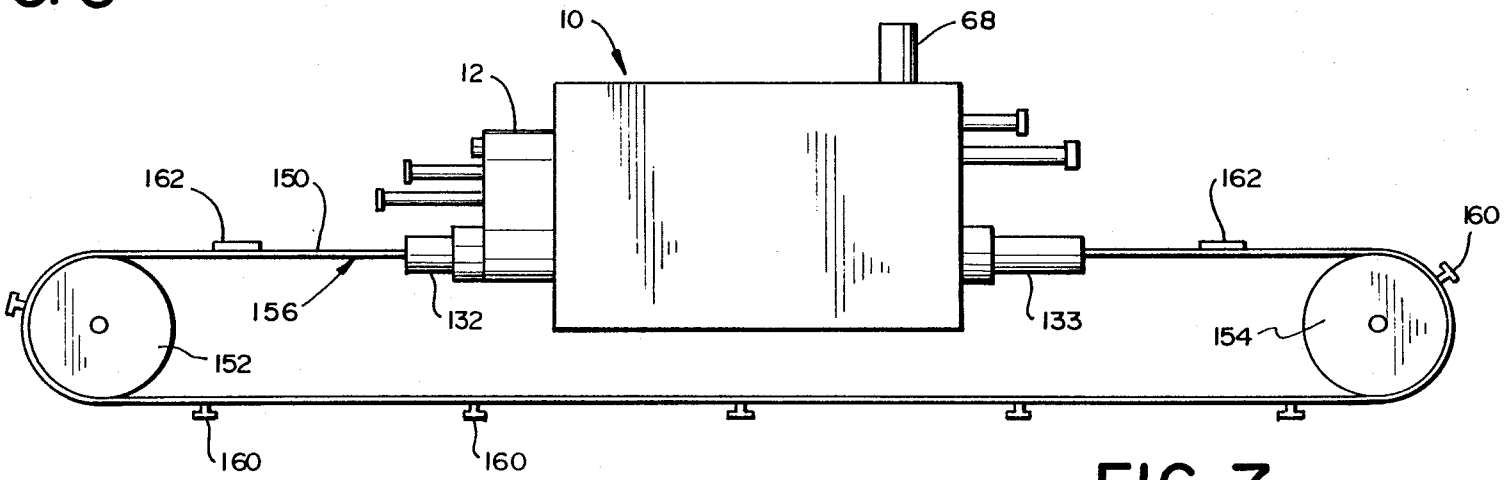
FIG. 7 is a side elevational view of a unit embodying the modification of FIG. 6.

Alternatlve embodiments of the invention are illustrated in FIGS. 6 and 7. As shown, tubular slide gates 132 and 133 are mounted in guides 92 and 94, respectively. Each slide gate includes an inner product feed tube such as the tube 134 having an inner ceramic liner 136 which may be coated with Teflon, as previously discussed with respect to FIG. 5. In addition, the slide gates 132 and 133 each include a cooling jacket 138 which surrounds and is spaced from the outer surface of tube 134 to provide an annular cooling chamber 140 in which cooling gas or liquid may be circulated to maintain the slide gate tube 134 at a desired temperature. The slide gate 132 is mounted in the guide 92 in end wall 16, as previously described with respect to FIG. 2, with the slide gate extending into the combustion chamber 14 of the combustor unit. The inner end of the slide gate may carry the collar 104 described above with respect to FIGS. 2 and 4. The slide gate 133 is similar to the slide gate 192 and is supported in axial alignment therewith by the slide collar 106 and by end guide 94, again in a manner illustrated in FIG. 2. In accordance with a preferred form of the invention, the slide gates 132 and 133 are oval in cross-section, with the long axis of the oval shape beIng parallel to the flow of gas in the combustion chamber. This shape is more aerodynamic, and thus produces less turbulence than a cylindrical slide gate. Another alternative is to provide slide gates having rectangular cross-sections, again with the long dimension of the cross-section being generally parallel to the gas flow.

The slide gates 132 and 133 may receive a product to be treated such as strand sO or, in the alternative, may carry a conveyor mechanism such as formed from a high temperature metal such as 316L stainless steel, Inconel, or oxygen dispersed steel. The conveyor may be in the form of a chain or a continuous loop belt such as that illustrated at 150 in FIG. 7, which passes around a pair of spaced pulleys 152 and 154, one of which is driven, with the upper run 156 of the belt passing through the slide gates and 132. The belt 150 may incorporate a plurality of mounting posts, such as those illustrated at 160, onto which articles to be treated, such as articles 162 illustrated in FIGS. 6 and 7, may be mounted for passage through the combustion chamber. The belt carries the articles to be treated through the combustion chamber at the desired rate so that the articles are exposed to the combustion products and to the process gases in the manner described above to effect the desired surface treatment.

In operating the device, suitable controls are provided to shift the movable slide gate 90 between a closed position with its end 102 in abutment with the end 100, and a selected open position for producing an aperture 112 of the desired length to treat the product passing therethrough. Typically, the aperture 112 will be in the range of one to six inches in width, with the slide gate 90 being moved either manually or by means of a suitable drive motor to select the desired width. In similar manner the fixed slide gate 88 may be positioned to locate the treatment aperture at the desired region of the combustion chamber either manually or by a suitable drive motor, with the slide gate 88 normally remaining in a fixed position during treatment operations and the gate 90 moving to open the aperture. However, it will be apparent that either one of the slide gates can be fixed and the other moved to open and close the gap 112, and that both may be moved for opening the gap, if desired. A suitable drive mechanism for adjusting the position of slide gate 90 in the combustion unit 10 is illustrated in FIG. 8, wherein a pneumatic or hydraulic cylinder 170 is connected by way of its drive piston 172 and a lever arm 174 to the slide gate 90. The lever arm may be connected to the slide gate by means of a collar 176, for example, while the lever is mounted at its central point 178 on an upright support post 180 carried by frame 96. The piston 170 may be mounted on frame 96, and may be adjustable so as to vary the motion of the lever arm, and thus the positioning of the slide gate 90. The cylinder 170 provides continuous positioning of the drive piston 172 and thus of the slide gate 90 so that the gap 112 may be adjusted as required. A similar drive arrangement may be provided for slide gate 88, if desired. Suitable drive arrangements may also be provided for the combustor of FIG. 7.

The gap 112 is continuously variable so that any desired amount of treatment can be provided for the material passing therethrough and can be completely closed to protect the strand or the articles in the event of any failure in the system. It will also be understood that the articles to be treated can pass in either direction through the slide gates so that as the article or strand enters the gap 112, it will be exposed first to a higher fuel content combustion product or to a higher oxygen content combustion product, as desired, thereby providing an additional range of adjustment for the system.

Thus there has been disclosed a system for treating a variety of materials or articles such as wire, tubing, tape, fabric, webs or discrete articles by passing them through the combustion chamber of highly controllable incinerator/combustor unit. The combustor can be used to treat any plastic material, such as nylon, polypropylene, polyethylene, and the like, as well as other materials with suitable process gases being added to the combustion products in a region of exposure to the hot gases within the combustion chamber so that the exposed surfaces of the article or product to be treated will be acted on by the high temperatures, the pressure standing waves, and the process gases contained in the combustion products to modify the surface characteristics of the material. Such treatment can affect the wetability, adhesion, colorability, printability, scratch or abrasion resistance and other characteristics of the product or material. Metals, glass, and the like can also be treated.

The treatment can be a reducing or an oxidizing process and any reactive gas can be added to any selected point in the combustion chamber so as to provide desired reactions at the aperture 112. The standing waves present in the combustor of the present invention will benefit the surface treatment process by enhancing reaction rates, creating free radicals in the process gas, and producing bond severance at the surface being treated. The treatment of the surface is further benefited by the presence of intense ultraviolet light in the combustor flame, for the ultraviolet is an important catalyst for many surface reactions. The combustor is capable of providing a high reactivity flame at low flame temperatures to thereby minimize the potential for thermal damage to the materials being treated.

The present invention has the advantage of being a low cost process for treatment of products since it can operate at atmospheric pressures, thereby eliminating the need for vacuum chambers and the associated equipment. The system is easy to operate and maintain and since the treatment takes place in a closed environment, toxic gases such as $N_2O$ and $NH_3$ can be introduced into the combustion chamber where they are consumed by the main flame or in the afterburner after treatment of the product. The system is consistent and provides reproducible results since the system can be regulated very precisely as to temperature, dwell time of the material in the treatment gap, and like parameters.

An example of an application of the present invention is as follows. A polypropylene fiber which is to be implanted in a polyvinyl chloride film requires improved wetability by a factor of 1.5 or 2 to 1. In accordance with the present invention, a strand of polypropylene fibers, which may be many single fibers together, is fed through the combustor of the present invention bY passing it into the slide gate and then into the treatment aperture 112, which is positioned in the standing wave zone of the combustor chamber. The chamber may be 14 inches in diameter and fired at a fuel injection rate of 125,000 BTU per hour. The air pressure in the main air manifold 22 is adjusted to yield a flame temperature of 1450° F. A flow of a process gas such as ammonia or steam is introduced at the point where the flame is extinguished, as detected by a flame rod technique. The strand speed is adjusted to between 100 ft and 300 ft per minute, and the slide gates are opened to expose a six inch length of the strand to the atmosphere within the combustion chamber. The treatment zone is located at the oxidizing portion of the combustion chamber, where there is an excess of oxYgen in the combustion products, and the strand is fed through the device continuously to treat the desired length. The fuel and air flow rates are adjusted as required to maintain the target temperature conditions. The flame and combustion products act on the strand of material to improve its wetability, thereby improving the strength of the fiber web laminate produced from the treated fiber.

Although the present invention has been described in terms of preferred embodiments thereof, it will be apparent that numerous modifications and variations may be made without departing from the true spirit and scope thereof as set forth in the following claims.

What is claimed is:

1. Material treatment apparatus, comprising:

an elongated combustion chamber having an inlet and an outlet end and a longitudinal axis;

fuel supply means at said inlet end of said combustion chamber;

air supply means extending the length of said chamber parallel to and spaced from said longitudinal axis and supplying air to said chamber in a direction to produce a helical flow of air and fuel and of combustion products produced by the burning of the air and fuel:

slide gate means extending through said combustion chamber, said slide gate means being parallel to and spaced from said longitudinal axis and including adjustable aperture means for selectively exposing material to be treated to selected regions of said combustion products.

2. The apparatus of claim 1, wherein said adjustable aperture means is adjustable longitudinally within said combustion chamber for positioning in selected region of said combustion products.

3. The apparatus of claim 2, wherein said adjustable aperture means is openable to a selected width.

4. The apparatus of claim 2, wherein said slide gate means includes a passageway for receiving material to be treated, said aperture means being openable to expose material in said aperture to said combustion products.

5. The apparatus of claim 4, further including inlet means supplying process gas to a selected location in said combustion chamber, said process gas mixing with said combustion products for treatment of material exposed by said aperture means.

6. The apparatus of claim 5, Wherein said slide gate and said air supply means are spaced equidistant from said axis to position said aperture means in the path of said helical flow of air, fuel and combustion products within said combustion chamber.

7. The apparatus of claim 5, wherein said slide gate means includes first and second material feeders having first and second slide gate axes, means aligning said first and second slide gate axes to be coaxial;

means mounting said first material feeder in said inlet end of said combustion chamber; and means mounting said second material feeder in said outlet end of said combustion chamber;

8. The apparatus of claim 7, wherein said first and second material feeders each have an inner end located within said combustion chamber, said aperture means being defined by said inner ends of said material feeders, whereby when said ends abut, said aperture is closed, and when said ends are parted, said aperture is open, the distance between said ends defining the width of said aperture.

9. The apparatus of claim 8, wherein said first and second material feeders each include an axially extending passageway.

10. The apparatus of claim 9, wherein said air supply means includes a plurality of air inlets spaced along the length of said combustion chamber for supplying a fuel rich air and fuel mixture in a region of said combustion chamber near the inlet thereof, a stoichiometric air and fuel mixture at a region of said combustion chamber near the longitudinal center thereof, and an air rich air and fuel mixture at a region of said combustion chamber near the outlet end thereof, and wherein said aperture means is longitudinally adjustable for positioning said aperture means in a selected one of said fuel rich, stoichiometric, or air rich regions.

11. The apparatus of claim 9, wherein said first and second material feeders each comprise a feed tube.

12. The apparatus of claim 11, wherein the material to be treated is a strand passing through said passageway in said feed tubes, said strand being exposed to said combustion products as it passes through said open aperture.

13. The apparatus of claim 12, further including means for longitudinally adjusting the positions of said feed tubes to position said aperture in a selected region of said combustion chamber.

14. The apparatus of claim 13, further including means for opening and closing said aperture.

15. The apparatus of claim 14, wherein said means for opening and closing said aperture includes drive means connected to at least one of said feed tubes.

* * * * *